United States Patent [19]

Grimes

[11] 4,046,358

[45] Sept. 6, 1977

[54] METHOD AND APPARATUS FOR MIXING AND DISPENSING MATERIAL

[75] Inventor: Charles Grimes, Decatur, Ga.

[73] Assignee: National Service Industries, Inc., Atlanta, Ga.

[21] Appl. No.: 685,086

[22] Filed: May 10, 1976

[51] Int. Cl.[2] ..... B28C 5/06

[52] U.S. Cl. ..... 259/147; 259/5; 259/151

[58] Field of Search ..... 259/5, 6, 7, 8, 9, 10, 259/147, 151, 64; 239/142

[56] References Cited

U.S. PATENT DOCUMENTS

| | | | |
|---|---|---|---|
| 1,684,370 | 9/1928 | Schuster | 259/147 |
| 1,755,329 | 4/1930 | McCormack | 259/151 |
| 2,970,773 | 2/1961 | Keryluk | 259/151 X |

*Primary Examiner*—Edward J. McCarthy
*Attorney, Agent, or Firm*—Patrick F. Henry

[57] ABSTRACT

The method may be employed for the mixture of certain types of products which require two or more component chemicals or compounds that must be mixed together immediately prior to use. The method comprises mixing the two compounds in the usual fashion inside of a mixing chamber by continuously supplying each of the compounds to the mixing chamber and then introducing air into the chamber while maintaining the chamber open at one end for the dispensing of the material whereby the air provides agitation for the mixture of the materials and provides a suction forwardly of the mixing chamber to draw the mixed compounds therefrom.

The apparatus is in the form of a mixing and dispensing gun which comprises a frame on which there is a previously known arrangement for introducing and supplying two or more chemical components to a mixing chamber thru a mixing block with which is mounted an air control valve system for controlling the entry of the two components. A mixing chamber has an air line connected thereto for the purpose of introducing air laterally or radially into the chamber with respect to the longitudinal centerline so as to mix the mixture therein and to provide a suction or Venturi effect outside the chamber to draw the mixed material therefrom.

15 Claims, 6 Drawing Figures

METHOD AND APPARATUS FOR MIXING AND DISPENSING MATERIAL

BACKGROUND OF THE INVENTION

1. Field of the Invention

Methods and apparatus for mixing and dispensing separately delivered fluid compounds (e.g. spray and dispensing guns) especially devices utilizing air or air pressure. Devices for mixing and dispensing plural (two or more) chemical components (e.g. resin and catalyst activator) under pressure.

2. Description of the Prior Art

The prior art includes many devices for feeding or mixing two component chemical systems such as the GUSMER (trademark) "AR" GUN sold by the Gusmer Corporation, Route 18 and Spring Valley Road, (Old Bridge, N.J., 08857, and described in the "Operating Manual". This gun utilizes a positive valving or isolation of two highly reactive liquid components. As mentioned in the Gusmer "Operating Manual", in the art of proportioning and/or dispensing certain factors are critical whereas other designs rely on a hydraulic seal being created by the inner face of the two liquid surfaces, in which the two liquids are indeed allowed to come in contact with one another, and wherein some chemical reaction will invariably occur, the "Gusmer (trademark) gun, which is displayed in the present drawings herein, various figures of the drawings, eliminates the gun sticking and distortion of pattern by what is in essence a positive sealing longitudinal valve, created by an elastically deformable valve rod through a throat section. However, it has been found that for certain applications of certain materials such as the Dow Corning "SYLGARD" (trademark) Elastomers which is a two-component A and B silicone elastomer of low viscosity that cures to a flexible, flame-retardant rubber when properly mixed with the catalyst (Dow Corning Bulletin 61-045 A dated 5-75), in use in atomic energy installations, was not properly expelled from the existing "Gusmer" (trademark) gun to meet the specifications required. The present invention utilizes certain components of the aforementioned "Gusmer" (trademark) Model "AR" gun or other twocomponent guns modified in such a way as to propel the mixed materials thru a nozzle into proper place.

SUMMARY OF THE INVENTION

A mixing and dispensing gun which includes a mixing valve of conventional construction (e.g. "Gusmer" (trademark) Model AR) for blending two or more chemical components in a mixing chamber ahead of which there is introduced a supply of air to create a suction or venturi effect to draw the mixed materials out of the chamber and thru the barrel of the gun.

In a modified version of the present invention, a mechanical agitator is employed ahead of the mixed material and ahead of the introduction of the air so as to agitate the mixed material prior to delivery from the barrel of the gun.

Other and further objects and advantages of the present invention will become apparent upon reading the following specification of a preferred embodiment taken in conjunction with the accompanying drawings in which:

DESCRIPTION OF THE PREFERRED EMBODIMENTS

Figure 4:
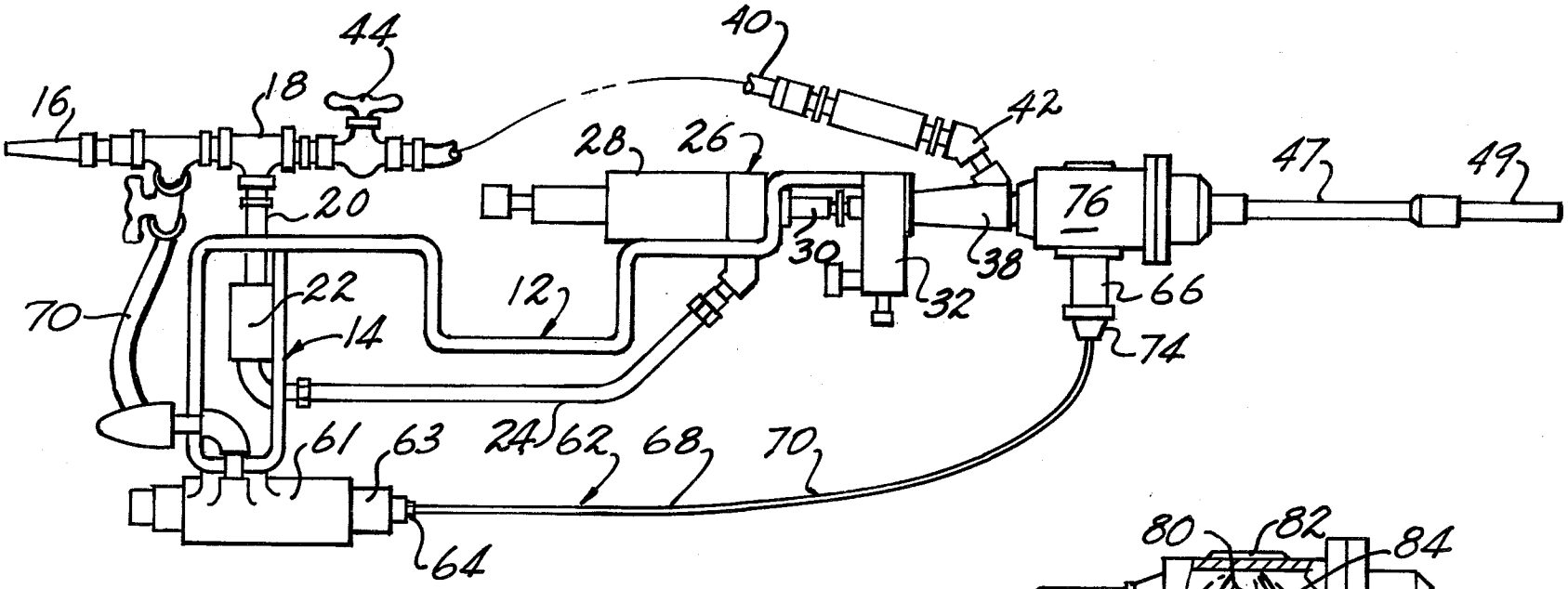
FIG. 4 is a longitudinal side elevation view of a second and modified form of the gun.

The present dispensing device is sometimes called a gun 10 and comprises an elongated, bent gun frame 12 having a pistol grip 14 comprising an open metal frame on which is mounted on air intake line 16 which includes a T-connection 18 supported on the handle 14 on a short pipe section 20 connected to a trigger control mechanism 22 leading to a control airline 24 which is connected to a "Gusmer" AR valve V an air control 26 which comprises an air cylinder 28 and on which is mounted a resiliently covered valving rod 30 for extension and retraction in a gun block 32 which is a receptacle housing for receiving the constituent ingredient lines A and B which are driven forward, the details of which are shown in FIG. 4 et al. at pages AR4 et al. of the "Operating Manual" of the Gusmer Corporation, Route 18, Spring Valley Road, Old Bridge, N.J., 08857. Valving rod 30 operates in a piston rod 37. The block 32 receives a mix adapter 38 which is a tubular body with a bore therein in which the mixture of the A and B compounds takes place, in accordance with the description and operation of the aforementioned Gusmer gun.

In the present embodiment, and which is an improvement and departure from the prior art, there is a mixing air hose 40 on frame 12 having a swivel hose connector 42 thereon screwed into the mixing adapter 38 whereby air delivery from the air intake 16 and controlled by means of a valve 44 is introduced into the interior of the mixing adapter 38. In the present gun, unlike the prior art arrangement, the mixing is not final in the mixing adapter 38 but rather continues after the introduction of the air thru the opening 46 into the interior of the adapter 38 and the subsequent emission of the two compounds and the air at the end of the mixing adapter chamber 38 thru a flexible hose 47 coupled at one end in connection with the adapter chamber 38. An outlet nozzle 49, of rigid pipe and the like, is attached to the end of the flexible hose 47.

Figures 1, 2, 6:
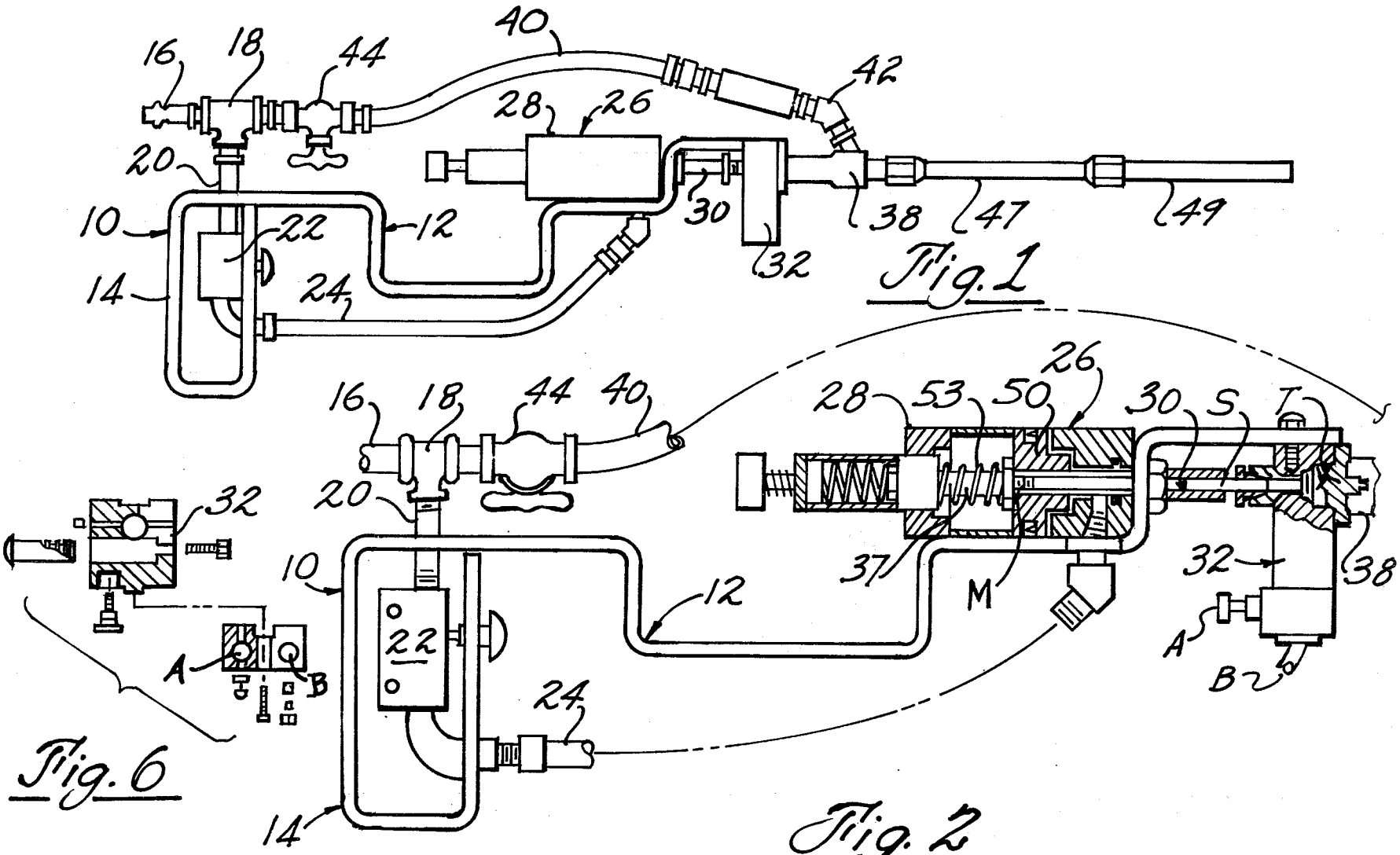
FIG. 1 is a longitudinal side elevation view of the first embodiment of the present gun which incorporates the prior art mixing.
FIG. 2 is an enlarged partial side elevation view of the gun shown in FIG. 1 with the prior art valve and mixing block in cross-section.
FIG. 6 is an enlarged disassembled front elevation assembly view of the prior art gun mixing block used in the present device.
Figure 3:
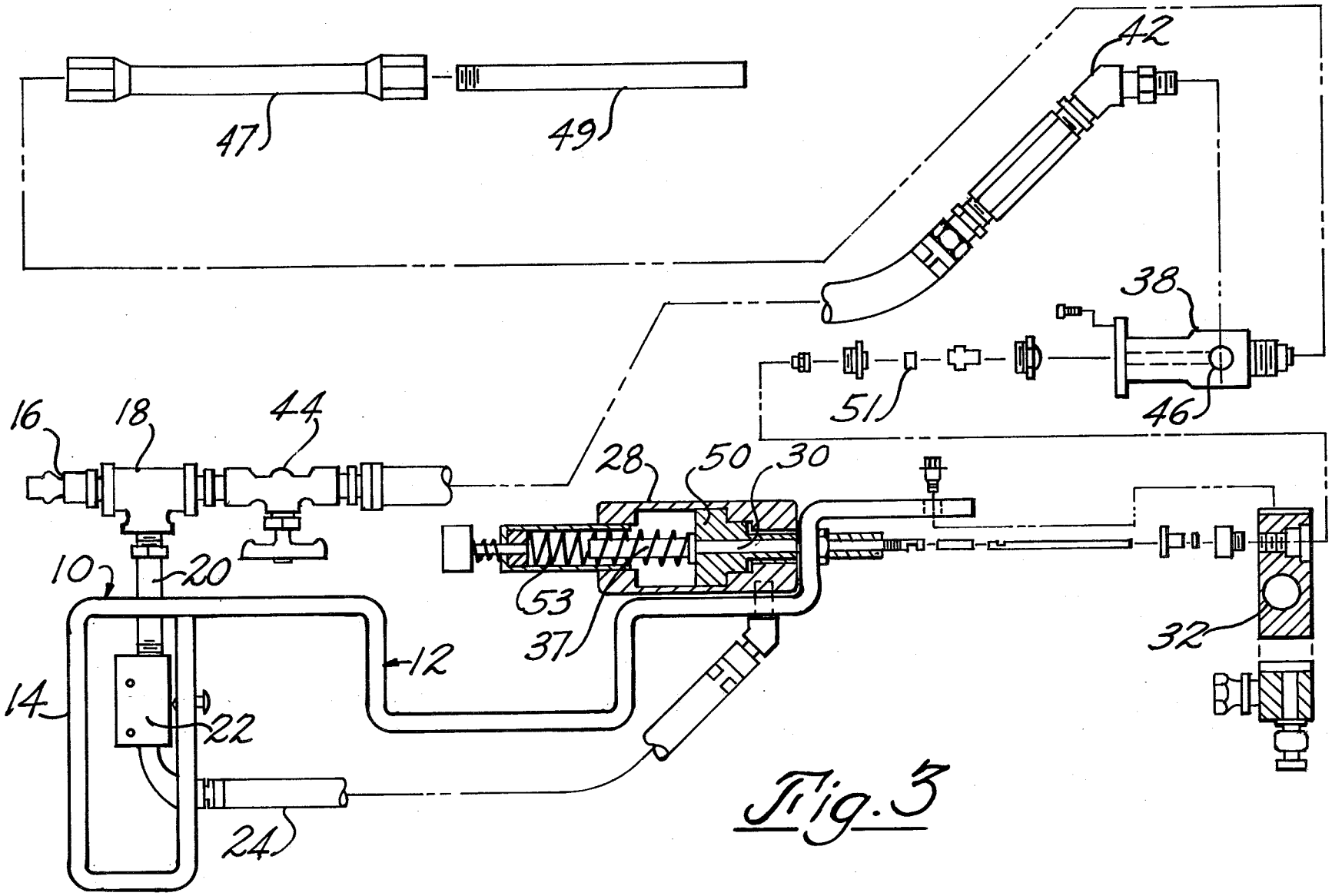
FIG. 3 is a disassembled assembly view of the gun shown in FIG. 1.

The prior art "Gusmer" (trademark) Model AR valve which is shown in FIGS. 2 and 3 is incorporated for descriptive purposes in the drawings, as seen in FIG. 2, which includes a cross-sectional view of the prior art rod 30 and throat T, the dimension of the hole in the throat through which the rod 30 must pass is less than the normal outside dimension of the rod 30 thereby creating an "interference" fit with the rod. The rod 30 construction plays an important role in how this works. It is comprised of two pieces, an internal threaded mandrel and an outside resilient sleeve S. Note that except where it is being compressed by the interference fit of the throat T, the sleeve S fits snugly over the outside dimension of the threads. As it passes through the throat the indentations of the threads in the mandrel permits the elastic sleeve S material to deform and fill these indentations thereby reducing the outside dimension of the rod 30 assembly enough to pass through the throat T. The result is perfect sealing (or isolation) of the two materials. In FIG. 2, the relationship of the throat T and rod 30 to the two materials can be observed. The "A" material ports are to the front of the throat section and the "B" material ports to the rear. The complete sealing created by the interference fit of the rod 30 through the throat T completely isolates these two materials A and B from one another in the off position, thereby eliminating any chemical reaction and consequently any problems of gun sticking, etc. The front and rear arrangement of the two materials A and B keeps the rear packing assembly bathed in the rear or resin material which actually contains a lubricant, the maintenance on this rear packing is vertually eliminated. There is no felt wiper to keep saturated, nor a need for one, since the rear packing is never subjected to mixed material. Looking at FIG. 2, which is a cutaway view of the gun cylinder assembly 28, you can see that the air cylinder 28 piston rod 37 is a hollow tubular sleeve which serves to guide the valving rod 30 which is inserted through it and held against it by a closure spring 53. When the trigger control 22 is depressed, a piston 50 and valving rod 30 are forced rearwardly by the 90–110 psi of air supplied to the gun, compressing the spring 53 until the valving rod 30 contacts the stop in the rear of the spring retainer case. This stop has two positions — the full open or "spray" position and the "service" position which allows partial movement of the valving rod without material flow. In operation, the valving rod 30 is withdrawn to the "spray" position. The rod 30 withdrawal creates what in essence is the mixing chamber, or the area in which the materials are first allowed to come into contact. There are several ports for the materials A and B created by impingers 51 which seat against both the front and rear sides of the throat section.

The front face of an impinger 51 is at the end with the slots and it conforms in shape to the concaved surface of the throat upon which it seats — in this way these slots form ports through which the front material will pass. The rear impinger has a similar slotted surface which bears against and seats on the rear surface of the throat. By subdividing the main streams of each material into several substreams, these impingers accomplish the first step of the mixing process. To further aid mixing these slots are inclined toward the slots of the opposite impinger. Also, the impinger slots are offset from the center line to promote the desirable degree of swirling motion of the materials A and B as they pass into the mixing adapter 38 chamber. This not only aids mixing, but is controlling the sizes and angles of the slots and by changing parts, it is possible to control the pattern size and shape, output, extent of atomization, and droplet size. The foregoing discussion with respect to the operation of the air cylinder 28, and rod 30, block 32, etc. is prior art.

Figure 5:
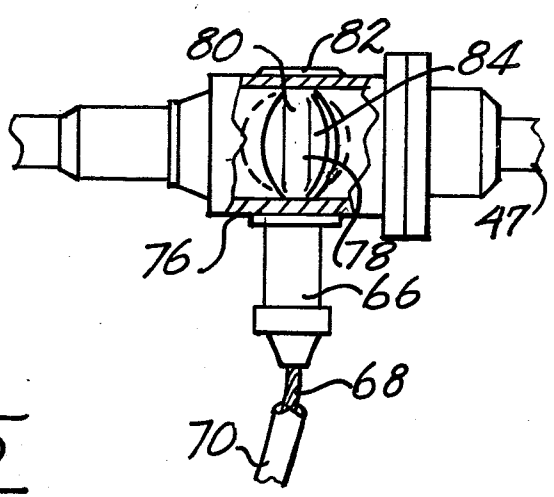
FIG. 5 is an enlarged view of the agitator in the gun in FIG. 4 partly in cross-section.

In the modified form of the gun which is shown in FIGS. 4 and 5 the operation and combination is the same except that there is a secondary air line 60 which leads to a small air motor 61, which may be of the sort made by Gast Corporation, which air motor 61 is connected to a drive assembly 62 comprising a housing 63 in which there is a shaft 64 coupled to the air motor shaft (not seen) and a chuck 66 connected to a flexible drive cable 68 inside of a flexible drive sleeve 70 which is connected to a fitting 74 mounted on an agitator housing 76 having an agitator chamber therein in which there is a rotary mixing agitator means 78 carried by a rotary shaft 80 mounted in a top bearing 82 and having attached thereto a flat circular agitator 84 which is mounted in a transverse plane to the longitudinal axis of the agitator chamber whereby the two mixed compounds A and B which are introduced into the agitator chamber are mixed by agitation and then fed into the flexible hose 47 on which is attached the rigid pipe 49. The air hose 47 is connected to the air input and is attached to the adapter chamber 38 in the same manner as the previous embodiment. When it is desired to clean the gun the introduction of the solution is discontinued and the air is introduced under pressure into the mixing adapter chamber 38 to force the remaining components A and B from the end of the gun and to prevent solidification and expansion and hardening which would clog the end of the gun and make it very difficult to clean same. There is a one-way valve in the air line which prevents the mixture of air from traveling backward in the air line but permits the air pressure to travel forward.

While there is shown and described one form of this invention together with a modification thereof, and the method employed, this is by way of illustration and does not constitute any sort of limitation on the scope of the invention since various alterations, changes, and deviations may be made in the embodiments shown and or in the operation thereof without departing from the scope of the invention defined herein only by proper interpretation of the appended claims.

What is claimed is:

1. Apparatus for mixing and dispensing two or more chemical compounds comprising:

a gun frame having means thereon for receiving two or more separate chemical components and for mixing same together, means on said frame for delivering said components under pressure, a mixing chamber on said frame into which said mixed components are discharged from said means for mixing, said mixing chamber having an inlet end and an outlet end, means on said frame comprising air under pressure in communication with and introduced into said mixing chamber forwardly of the discharge of said mixed components from said means for mixing same for producing a suction in the inlet end of said mixing chamber and pressure in the outlet end, and a discharge barrel on said gun frame in communication with said mixing chamber and into which said mixed components are forced by air to exit from said barrel.

2. The device claimed in claim 1 wherein said air is conducted through an air line which is connected to said mixing chamber to deliver air tangentially therein and to produce a venturi effect in said mixing chamber.

3. The device claimed in claim 2 wherein said components are mixed in a mixing block on said frame under pressure therein and there is a valve control means controlling the mixture of said components in response to an air operated valve.

4. The device claimed in claim 1 wherein there is a mechanical agitating chamber on said gun and a mechanical agitator in said agitating chamber in communication with said mixing chamber and said agitator being movable therein.

5. The device claimed in claim 4 wherein said movable agitator is a rotatable member mounted in said chamber on a shaft transversely located therein, an air motor on said frame, and means connecting said air motor to said agitator to rotate same.

6. The device claimed in claim 5 wherein said means connecting said air motor is a flexible cable drive having one end drivably connected with said air motor and the other end drivably connected to said agitator member.

7. The device in claim 5 wherein said shaft is substantially transverse of said chamber and said agitator is located transversely therein.

8. The device in claim 1 wherein said components are mixed in a mixing block under pressure from a respective delivery line leading to a valving means comprising a flexible valving rod operating in a throat.

9. Apparatus for mixing and dispensing two or more chemical components wherein there is a means for delivering two or more components such as a resin and an activator under pressure, a valving means on said apparatus for controlling the mixing of the components thru a throat in which there is operated a flexible valving rod, a gun frame having means thereon receiving two or more separate chemical components under pressure and for mixing same together in a block from whence said mixture is discharged, the improvement comprising:

a mixing chamber on said frame into which said mixing components are discharged from said block, air pressure means on said frame connected to said mixing chamber forwardly of the discharge of said mixing components from said means for mixing same to creat a venturi therein, an air line connected to said mixing chamber to introduce air at an angle to the longitudinal axes of said mixing chamber, a discharge barrel on said gun frame in communication with said mixing chamber and into which said mixed components are forced by air to exit from said barrel.

10. The device claimed in claim 9 wherein there is a mechanical agitator on said gun comprising an agitation chamber in communication with said mixing chamber and a movable agitator member therein.

11. The device claimed in claim 10 wherein said movable agitator is a rotatable member mounted in said chamber on a shaft transversely located therein, an air motor on said frame, and means connecting said air motor to said agitator to rotate same.

12. The device claimed in claim 11 wherein said means connecting said air motor is a flexible cable drive having one end drivably connected with said air motor and the other end drivably connected to said agitator member.

13. A method of dispensing a blended mixture of two separate components which have been mixed under pressure to each individual component and wherein said components are mixed in a mixing block: providing a mixing chamber in communication with the outlet on said mixing block and delivering said mixed components into one entrance end of said mixing chamber having a thru passageway therein, creating a suction on said mixture at said entrance end and said mixing chamber, and forcing said mixture from the other end of said mixing chamber.

14. The method in claim 13, creating said suction by introducing air pressure into said mixing chamber at an angle to the longitudinal axis thereof, and directing said air pressure thru said chamber to produce pressure to force said mixture from the end.

15. The method in claim 13 providing an agitating chamber in communication with said mixing chamber, and agitating said mixture in said agitating chamber.

* * * * *